US008708652B2

(12) United States Patent
Caprario et al.

(10) Patent No.: US 8,708,652 B2
(45) Date of Patent: Apr. 29, 2014

(54) COVER PLATE FOR TURBINE ROTOR HAVING ENCLOSED PUMP FOR COOLING AIR

(75) Inventors: Joseph T. Caprario, Cromwell, CT (US); Eric A. Hudson, Harwinton, CT (US)

(73) Assignee: United Technologies Corporation, Hartford, CT (US)

( * ) Notice: Subject to any disclaimer, the term of this patent is extended or adjusted under 35 U.S.C. 154(b) by 2066 days.

(21) Appl. No.: 11/768,996

(22) Filed: Jun. 27, 2007

(65) Prior Publication Data

US 2009/0004012 A1 Jan. 1, 2009

(51) Int. Cl.
*F01D 5/08* (2006.01)
*F01D 5/18* (2006.01)

(52) U.S. Cl.
USPC ..... 416/96 R; 416/95; 416/97 R; 416/220 R

(58) Field of Classification Search
USPC ..... 415/115, 116, 173.7, 174.5; 416/95, 416/96 R, 96 A, 97 R, 220 R
See application file for complete search history.

(56) References Cited

U.S. PATENT DOCUMENTS

| | | | | | |
|---|---|---|---|---|---|
| 2,928,650 | A | * | 3/1960 | Hooker et al. | 416/96 R |
| 3,300,179 | A | | 1/1967 | Gooderum | |
| 3,395,891 | A | | 8/1968 | Burge | |
| 3,715,170 | A | * | 2/1973 | Savage et al. | 416/97 R |
| 3,936,222 | A | | 2/1976 | Asplund | |
| 4,505,640 | A | | 3/1985 | Hsing | |
| 4,645,424 | A | | 2/1987 | Peters | |
| 4,820,116 | A | * | 4/1989 | Hovan et al. | 415/115 |
| 5,018,943 | A | * | 5/1991 | Corsmeier et al. | 416/144 |
| 5,256,035 | A | | 10/1993 | Norris | |
| 5,575,616 | A | * | 11/1996 | Hagle et al. | 415/115 |
| 5,700,130 | A | * | 12/1997 | Barbot et al. | 416/95 |
| 5,727,927 | A | | 3/1998 | Luxenburger | |
| 5,816,776 | A | * | 10/1998 | Chambon et al. | 415/174.5 |
| 5,951,241 | A | | 9/1999 | Dahlheimer | |
| 5,984,636 | A | * | 11/1999 | Fahndrich et al. | 416/96 R |
| 5,993,160 | A | | 11/1999 | Bouchard | |
| 6,499,945 | B1 | | 12/2002 | Lathrop | |

* cited by examiner

*Primary Examiner* — Christopher Verdier
(74) *Attorney, Agent, or Firm* — Carson, Gaskey & Olds, PC

(57) ABSTRACT

A cover plate for use with a rotor disk in a gas turbine engine includes an enclosed chamber associated with a web on the rotor disk. The enclosed chamber ensures that adequate cooling air is delivered by rotation of the cover plate.

2 Claims, 2 Drawing Sheets

COVER PLATE FOR TURBINE ROTOR HAVING ENCLOSED PUMP FOR COOLING AIR

BACKGROUND OF THE INVENTION

This application relates to a cover plate for a turbine rotor disk in a gas turbine engine, wherein the cover plate has an enclosed pumping chamber for moving a cooling air from a central location to a cooling passage for delivering the air to a turbine blade.

Gas turbine engines are known, and typically include a compressor for delivering air downstream to a combustion section. The air is mixed with fuel and burned in the combustion section, and the products of combustion move downstream over turbine rotors, driving the turbine rotors to rotate. The turbine rotors typically include a rotor disk, and a plurality of circumferentially spaced removable turbine blades. Since the rotor disk and turbine blades are subject to extreme temperatures, cooling air is typically delivered to these components to cool them.

Some of the cooling air is delivered from a central location in the rotor disk radially outwardly to the interior of a disk slot in the rotor disk. The disk slot receives a root section from the turbine blade. The air then communicates into cooling air passages in the turbine blade.

To seal the cooling passages, cover plates are typically attached to the rotor disk. Cover plates that form a small gap by following the contour of the disk create a boundary layer effect that pumps cooling air from a central location to the radially outward location when the cover plate and rotor rotate. The cover plates have been formed with internal fins which increases the pumping effectiveness. However, these fins have been somewhat ineffective at locations where the rotor may bend away from the cover plate. As an example, a central web of the rotor may be thinner than radially inner and outer portions of the rotor. This may be due to a desire to reduce the weight of the rotor, or for other reasons. In the past, the cover plate has been ineffective in moving cooling air when it is spaced from this central web.

On the other hand, a cover plate that it is formed to follow the central web of the rotor, might well cause stress concentrations which would require the cover plate to be unduly large and heavy.

SUMMARY OF THE INVENTION

In the disclosed embodiment of this invention, a cover plate for a rotor disk and a gas turbine engine has a pumping chamber on an interior face, wherein the pumping chamber is enclosed between axially inner and outer walls. The enclosed chamber is associated with an axially smaller web of the rotor disk.

These and other features of the present invention can be best understood from the following specification and drawings, the following of which is a brief description.

DETAILED DESCRIPTION OF THE PREFERRED EMBODIMENT

A gas turbine engine 10, such as a turbofan gas turbine engine, circumferentially disposed about an engine centerline

Figure 1:
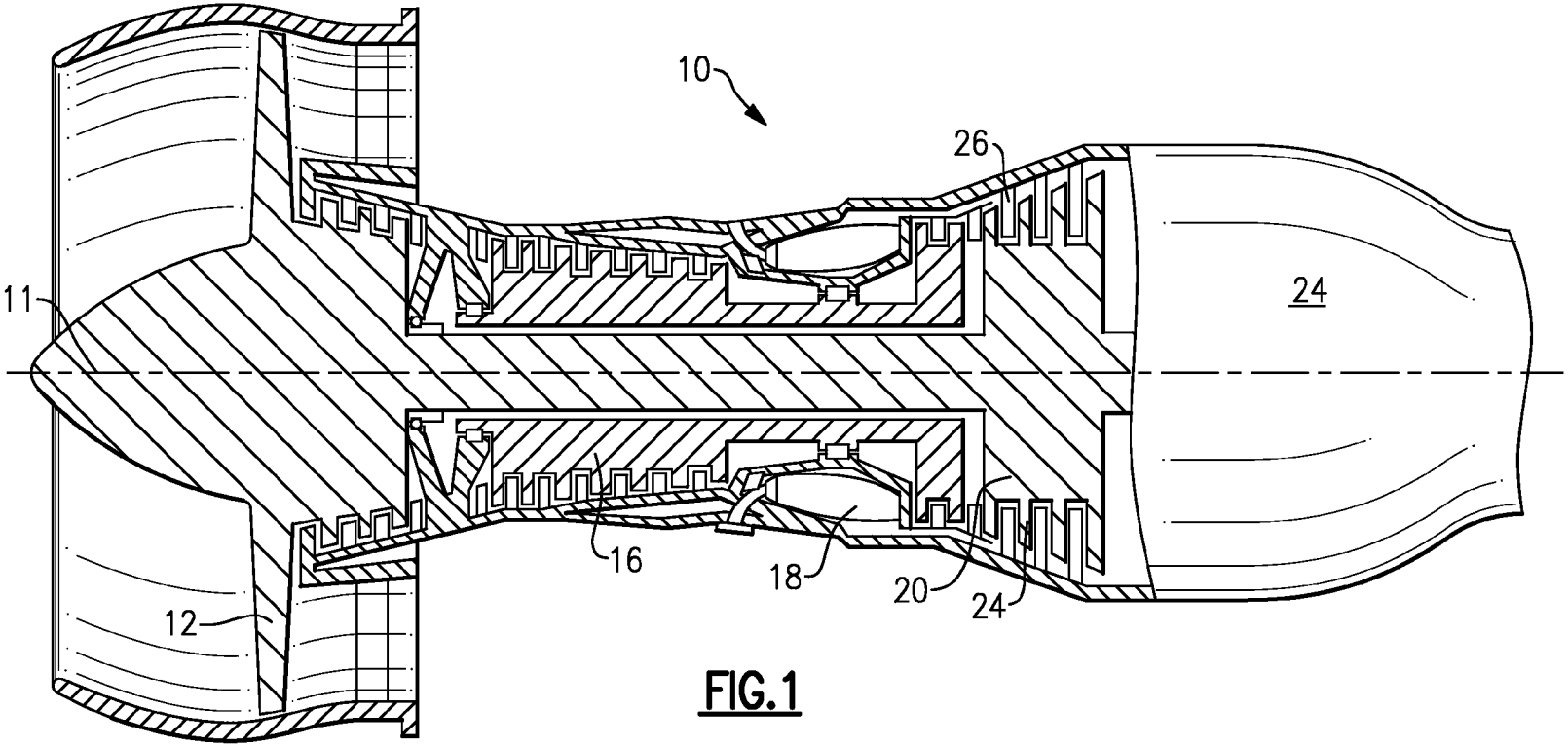
FIG. 1 is a schematic view of a gas turbine engine.

11, is shown in FIG. 1. The engine 10 includes a fan 12, a compressor 16, a combustion section 18 and turbine sections 20. As is well known in the art, air compressed in the compressor 16 is mixed with fuel which is burned in the combustion section 18 and expanded across turbines 20. The turbines 20 includes rotors that rotate in response to the expansion, driving the compressor 16 and fan 14. The turbines 20 comprises alternating rows of rotary airfoils or blades 24 and static airfoils or vanes 26. This structure is shown somewhat schematically in FIG. 1. While one example gas turbine engine is illustrated, it should be understood this invention extends to any other type gas turbine engine for any application.

Figure 2:
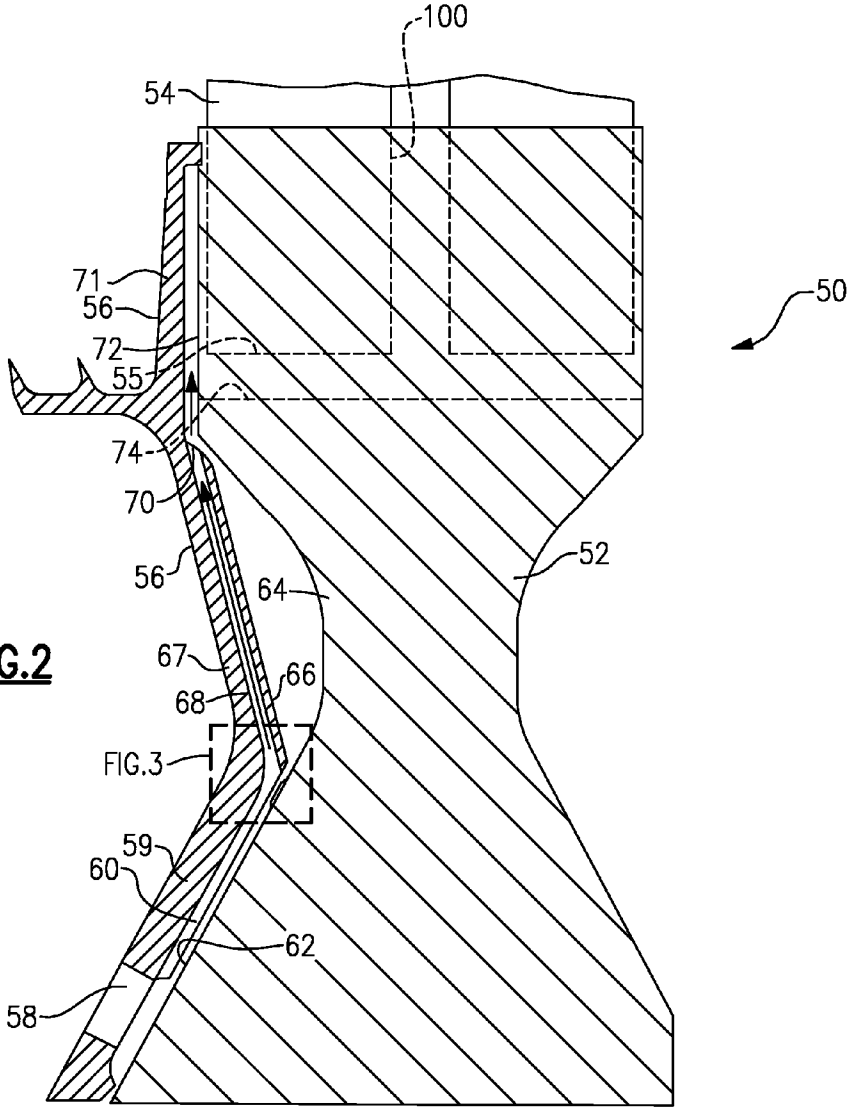
FIG. 2 is a cross-sectional view through a rotor having a cover plate according to this invention.

FIG. 2 shows a rotor section 50 having a rotor disk 52. As known, a disk slot receives a root of a turbine blade 54. The disk slot is formed by circumferentially spaced and alternating slots and solid sections. The turbine blades 54 are received in the slots. The aspect is shown somewhat schematically.

A cover plate 56 is secured to the rotor disk 52. This connection may be as known in the art. As examples, a retaining ring, a bolt at the inner portion of the disk, or a clamp against the disk through various means may be used.

Figure 3:
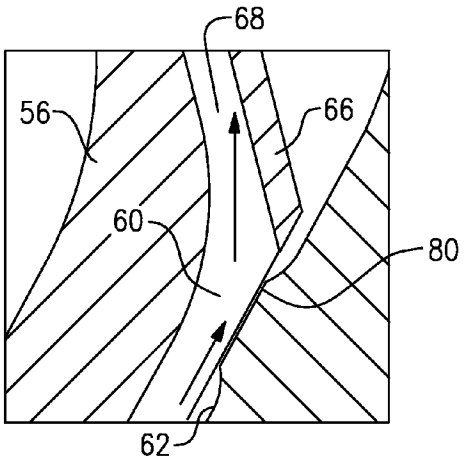
FIG. 3 is an enlarged view of the FIG. 2 cover plate.

A cooling air supply 58 supplies cooling air to a surface between an axially downstream side of the cover plate 56 and an axially upstream face 62 of the rotor disk 52. In order to improve air pumping effectiveness, fins may be incorporated into the cover plate 56. The fins can be located on the lower portion of the cover plate 56 or inside the chamber 68 or both. Fins need not extend along the entirety of these portions or be continuous. The fin geometry shown in FIG. 2 and FIG. 3 is only one potential embodiment.

A portion 59 of the cover plate may have a plurality of fins 60 which are closely spaced from the surface 62. As the rotor disk 52 and cover plate 56 are driven to rotate by the products of combustion, these fins 60 pump air radially outwardly. This portion of the illustrated embodiment is generally as known in the art.

As shown, the cover plate 56 diverges axially upstream away from the central web 64 of the rotor 52. At this portion 67 of the cover plate, an axially downstream wall 66 is spaced from the wall 67 to define an intermediate chamber 68. The chamber 68 may be provided with fins, like the radially inner portion 59 of the cover plate. Now, even though the web 64 is spaced from the cover plate, there will still be pumping through chamber 68. A downstream end 70 of the chamber 68 empties adjacent an outer face 72 of the rotor 52 and into a passage 74 leading to the disk slot which receives the turbine blade 54. As shown, the turbine blade 54 has a flow passage 100 to deliver the cooling air outwardly to its airfoil. Again, this structure is shown schematically. As can be appreciated, the intermediate chamber 68 is defined by a plurality of passages separated by the fins. As also can be appreciated from the F*igure* 2, the downstream wall 66 ends at the approximate location where the radially inner portion begins, such that the radially inner portion fins 60 are not separated from a face 62 of the rotor by a downstream wall. Further, the intermediate or enclosed chamber 68 is at least partially aligned with the central web 64.

By enclosing the chamber 68 along the web 64, there is still adequate pumping of the cooling air. In the prior art, since the cover plate is further spaced from the thinner web 64, adequate pumping may not have occurred.

FIG. 3 shows another feature 80, which is formed on the face 62. Feature 80 bends the air flow upwardly into the chamber 68, and further serves as a bumper for positioning the cover plate 56. This feature 80 is optional and need not be included in all embodiments of this invention.

As is clear from Figures 2 and 3, the portion 67 of the cover plate 56 bends in an upstream direction away from the radially inner portion 59. Further, there is no downstream wall 56 associated with the portion 59, such that fins 60 face the surface 62.

As shown in FIG. 2, a radially outermost end of the cover plate 56 is beyond a radially innermost end 55 of the root of the turbine blade 54. As is known, a main purpose of the cover plate 56 is to seal the air and gas flow passages that are formed between the rotor and disk slot.

The cover plate can be formed by machining operations in an integral component to create the chamber 68. On the other hand, a downstream wall can be attached to a main cover plate body by methods including, but not limited to, brazing or bonding. An integral cover plate could also be cast with the chamber built into the casting. These methods do not exclude other methods of manufacturing.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A turbine rotor for a gas turbine engine comprising:

a rotor disk having a central web which has an outer face spaced further downstream of a central axis than an outer face of a radially inner portion of the rotor disk;

a cover plate secured to the rotor disk, said cover plate having an enclosed chamber for moving air from a radially inner portion towards a radially outer portion and into cooling air passages to be associated with a turbine blade, said enclosed chamber being at least partially aligned with the central web, and said radially inner portion of said cover plate having ribs extending toward the radially inner portion of said rotor disk; and said enclosed chamber defined by an upstream wall facing away from said rotor disk, and a downstream wall facing a surface of said rotor disk, said downstream wall ending radially outwardly of said radially inner portion of said cover plate, wherein an abutment on said rotor disk serves to direct air into said enclosed chamber, and further provides a positioning stop for said cover plate.

2. A cover plate for a turbine rotor comprising:

an axially upstream wall, and an axially downstream wall, an enclosed chamber for receiving a cooling air supply and pumping the cooling air radially outwardly to communicate into a cooling air passage into a rotor disk to be attached to the cover plate, said enclosed chamber being formed between said axially upstream and axially downstream walls, and a radially inner portion having ribs extending from an extension of said axially upstream wall; and said axially downstream wall ending radially outwardly of said radially inner portion, wherein said cover plate has fins for moving air into the enclosed chamber, with said fins being positioned radially inward of said enclosed chamber.

* * * * *